US005660269A

United States Patent [19]

Fujiwara

[11] Patent Number: 5,660,269

[45] Date of Patent: Aug. 26, 1997

[54] SWITCH

[75] Inventor: Hideki Fujiwara, Matsudo, Japan

[73] Assignee: Uniden Corporation, Tokyo, Japan

[21] Appl. No.: 590,972

[22] Filed: Jan. 24, 1996

[30] Foreign Application Priority Data

Nov. 15, 1995 [JP] Japan ..... 7-297168

[51] Int. Cl.[6] ..... H01H 1/06

[52] U.S. Cl. ..... 200/275; 200/292; 200/239; 361/772; 361/777

[58] Field of Search ..... 200/275, 278, 200/292, 512, 514, 243, 239; 29/622; 361/748, 760, 764, 772, 774, 777, 778, 779

[56] References Cited

U.S. PATENT DOCUMENTS 4,501,938 2/1985 Kawauchi ..... 200/512

4,531,033 7/1985 Schmid et al. ..... 200/512

4,857,683 8/1989 Maser ..... 200/512

FOREIGN PATENT DOCUMENTS 64-36932 3/1989 Japan .

4-61821 5/1992 Japan .

*Primary Examiner*—David J. Walczak

*Attorney, Agent, or Firm*—Lowe, Price, LeBlanc & Becker

[57] ABSTRACT

A switch having two planes opposing and substantially in parallel to each other and switching between a first electrode and another electrode by pressing down one of the planes. Contact point patterns each made of a conductive material having a specified shape are provided on one of the planes. Stripe electrode patterns in which the first electrode and the other electrode are alternately positioned are provided on the other plane in a region where the contact pattern on the one plane is superimposed when that plane is pressed down.

16 Claims, 4 Drawing Sheets

CARBON ELECTRODE PATTERN

SILK PATTERN OR RESIST PATTERN

COPPER FOIL PATTERN

SILK PATTERN OR RESIST PATTERN

SWITCH

This patent application is the subject of a submission under the Disclosure Document Program, which was filed thereunder by applicants on Jul. 17, 1994 and identified as Disclosure Document No. 379755 with its accompanying fee paid under the provisions of all the Rules and Regulations including 37 CFR $1.21(c).

FIELD OF THE INVENTION

The present invention relates to construction of a contact point of a switch such as a key switch, and more particularly to a switch small in size but low in contact resistance.

BACKGROUND OF THE INVENTION

Conventionally, as a construction of the contact point of a switch in a key switch used for, for instance, a cordless telephone set, a carbon electrode pattern is arranged in an interdigitized shape on a printed wiring board, and a conductive material pattern is arranged on the rear surface of a key rubber. The key switch is turned ON/OFF by pressing down the surface of the key rubber.

Also as a material used for a contact point of a key switch, there are a gold-plated contact point and a palladium contact point in addition to a carbon contact point. Such contact points are to be subjected to carbon processing, gold flash processing, and palladium processing respectively in a manufacturing process. However, when these types of processing are viewed from the point of cost, assuming that gold flash processing is 100 [%] in terms of cost, palladium processing is 90 [%] and carbon processing is 60 [%]. For this reason application of a carbon contact point thereto allows a substantial contribution to cost reduction of the products.

It should be noted that, from the view point of reliability, a gold-plated contact point is excellent in reliability, and a carbon contact point is inferior to a gold-plated one. Also a palladium contact point has some problems of migration between palladium and copper foil, accordingly a palladium contact point is slightly inferior in reliability to a gold-plated one.

Also from the view point of small size, for instance, in the case of a substrate having two copper foil layers, a minimum pattern width of a gold-plated contact point and a palladium contact point is 0.2 [mm] which is substantially equivalent to a copper foil pattern. This is in contrast a minimum pattern width of a carbon contact point is 0.4 [mm], which is not suitable for fine working (namely, forming a complicated contact point pattern), and the problem described above has been left unsolved.

Furthermore, there is a demand for a recent cordless telephone set having each key therein expected to be lit individually by a back light so that each of function keys is possible to be identified even in the night or in dark places. For this reason light emitting elements such as a light-emitting diode, are provided in the peripheral section of the key or inside the key region, whereby various types of products responding to the demand have been developed.

In a switch using the conventional type of carbon contact point described above, however, there have been some problems that, for instance, to make a key light individually, it is required to provide light emitting elements inside the key region. Accordingly, the area for the carbon electrode pattern as a contact point of a key switch becomes smaller by the portion equivalent to the area for the light emitting elements as described above. In products requiring size reduction, the key region can not be widened, which resultantly causes imperfect contact on the contact point of a switch, and the reliability thereof is reduced.

Also in this case, although a carbon electrode pattern is to be provided adjacent to the periphery of the light emitting elements, luminous efficiency of the light emitting elements is reduced because carbon is black and absorbs light.

SUMMARY OF THE INVENTION

It is an object of the present invention to provide a switch assuring continued high-reliability without causing imperfect contact at the contact point thereof due to increase of contact resistance even under such conditions that the area for an electrode pattern of a switch has to be made smaller due to a demand for size reduction in products applying the switch and demand imposed constraints to the arrangement therein of parts of the switch.

It is another object of the present invention to provide a switch enabling secure switching of connection/disconnection between electrodes even when pressure for pressing down the key is local and nonuniform thereon.

As described above, with the switch according to the first feature of the present invention, a contact point pattern formed with a conductive material having a specified form is provided on one of two planes, and a stripe electrode pattern in which a first (e.g. the minus) electrode and another electrode are alternatively positioned is provided on the other plane in a region where the contact point patterns on the one plane are superimposed when the one plane is pressed down. Even under such conditions that the area for an electrode pattern in the switch has to be made smaller due to a demand for size reduction in products with the switch applied therein, and demand imposed constraints to arrangement therein of parts of the switch, it is possible to realize a switch assuring continued high-reliability without causing imperfect contact at the contact point thereof due to increase of contact resistance.

Also even in a case where the pressure for pressing down one plane is local and nonuniform thereon, conduction of any electrodes adjacent each other in any of the parts in stripe electrode patterns allows the switch to be in a state of connection, so that accurate switching becomes possible, which makes it possible to provide a high-reliability switch.

With the switch according to a second feature of the present invention, in a case where parts different from the switch are provided on the other plane described above, in the region where the two planes are superimposed when the one plane is pressed down, the region which can be used as an electrode pattern on the other plane is limited to a region excluding a region on which other parts different therefrom are provided and a region accompanying the parts described above. However, it is possible to realize a switch assuring continued high-reliability by providing the stripe electrode patterns thereon.

Furthermore, with the switch according to a third feature of the present invention, the electrode pattern on the other plane described above is formed with carbon, whereby the manufacturing process can be simplified and cost reduction of the products can also be achieved. Even in a case where light emitting elements are employed for the parts different therefrom described above, electrode patterns can be formed on a smaller electrode area, so that it is possible to realize a switch enabling suppression of any reduction in luminous efficiency of the light emitting elements, and in addition thereto, assuring continued high-reliability thereof.

Other objects and features of this invention will become understood from the following description with reference to the accompanying drawings.

BRIEF DESCRIPTION OF DRAWINGS

FIG. 1A is a carbon electrode pattern, FIG. 1B and FIG. 1D is a silk pattern each of or a resist pattern, and FIG. 1C is a copper foil pattern;

DETAILED DESCRIPTION OF THE PREFERRED EMBODIMENTS

Figure 1A:
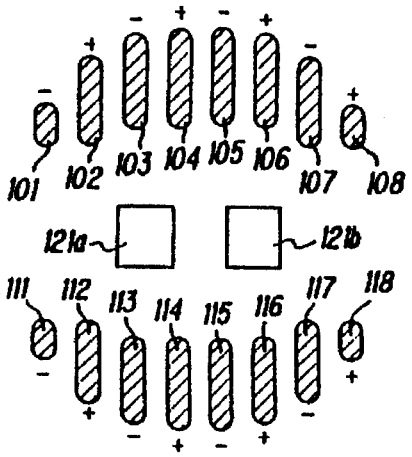
FIGS. 1A to 1D are pattern views of each layer to be printed on a printed wiring substrate for a key switch according to an embodiment of the present invention.

Detailed description is made hereinafter for an outline of a switch according to the present invention, and for embodiments of the switch according to the present invention with reference to the related drawings.

In a switch according to a first feature of the present invention, as shown in, for instance, FIGS. 1A to 1C and FIG. 3, having two planes opposing and substantially in parallel to each other for switching a connection or disconnection between a first (e.g. a minus) electrode and another electrode when one of the planes is pressed down contact patterns 301*a* and 301*b* each formed with a conductive material having a specified form are provided on one of the planes. Stripe electrode patterns 101 to 108 and 111 to 118 in which the minus electrode and the other electrode are alternatively positioned are provided on the other plane in a region where the contact point patterns on the one plane are superimposed when the one plane is pressed down.

For instance, even under such conditions that an area for an electrode pattern in the switch has to be made smaller due to a demand for size reduction in products with the switch applied therein and constraints to arrangement therein of parts of the switch in accordance with the demand, it is possible to realize a switch assuring continued high-reliability without causing imperfect contact at the contact point thereof due to increase of contact resistance. Also even when the pressure by pressing down the one plane is local and nonuniform thereon, and conduction of any electrodes adjacent each other in any of the parts in stripe electrode patterns 101 to 108 and 111 to 118 allows the switch to be in state of connection, so that accurate switching becomes possible, which makes it possible to enhance reliability of the switch.

In a switch according to a second feature of the present invention, other parts different from the switch are provided on the other plane described above in the region where the two planes are superimposed when the one plane is pressed down.

For instance, in a case where the switch is applied to a cordless telephone set or the like, there is a demand that keys are expected to be lit individually by a back light so that function keys become possible to be identified even in the night or in any dark places, and as shown in FIG. 1, light emitting elements such as a light-emitting diode are to be provided each at the position of 121*a* and 121*b* inside of the key region. In this case, the region which can be used as an electrode pattern on the other plane is limited to a region excluding regions 121*a* and 121*b* on which the light emitting elements are to be provided and a wiring region accompanying the light emitting elements. However, it is possible to realize a switch assuring continued high-reliability by providing the stripe electrode patterns 101 to 108 and 111 to 118 of the present invention thereon.

Furthermore, in a switch according to a third feature of the present invention, the electrode pattern on the other plane described above is formed with carbon, whereby the manufacturing process can be simplified and cost reduction of the products can also be achieved. Also in a case where light emitting elements are provided in the key region, although carbon is black and has a tendency of absorbing light, the stripe electrode patterns 101 to 108 and 110 to 118 of the present invention can be formed on a smaller electrode area. Hence, it is possible to realize a switch enabling suppression of a reduction in luminous efficiency of the light emitting elements, and addition thereto, assuring continued high-reliability thereof.

The switch according to an embodiment of the present invention is applied to a number key or a function key or the like for a cordless telephone set, and is a key switch in which keys can be lit individually with a back light so that any of the keys can be identified even in the night and in any dark places.

Figure 1B:
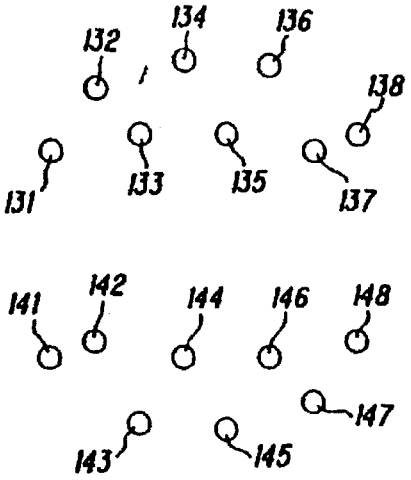
Figure 1C:
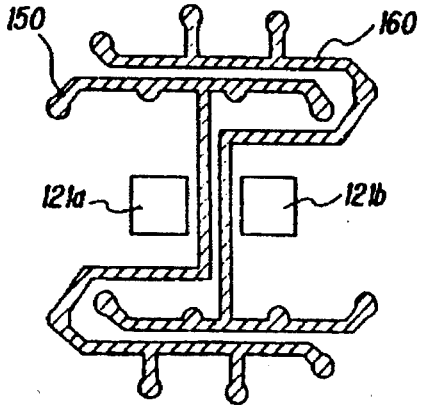
Figure 2:
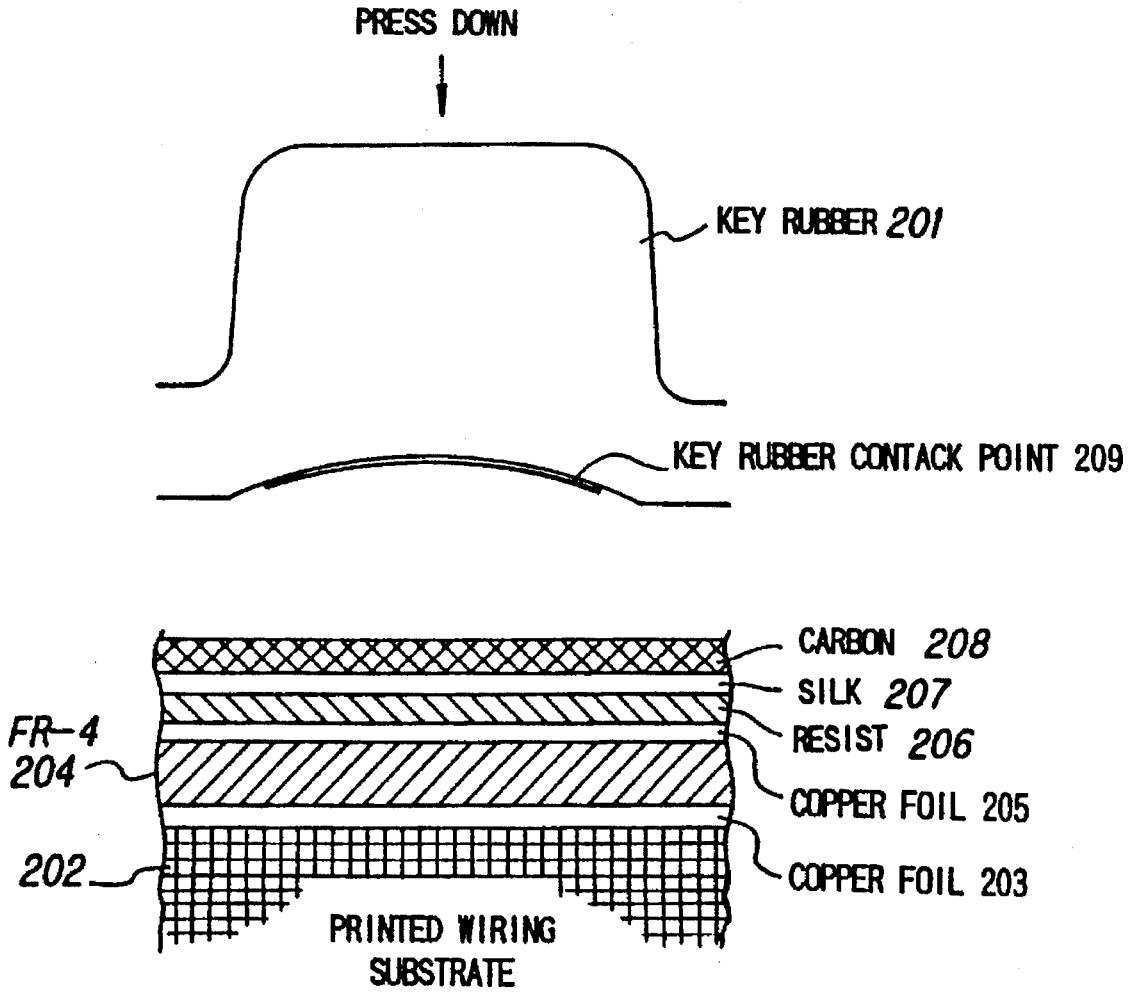
FIG. 2 is a schematic sectional view showing a key switch according to an embodiment of the present invention.
Figure 3:
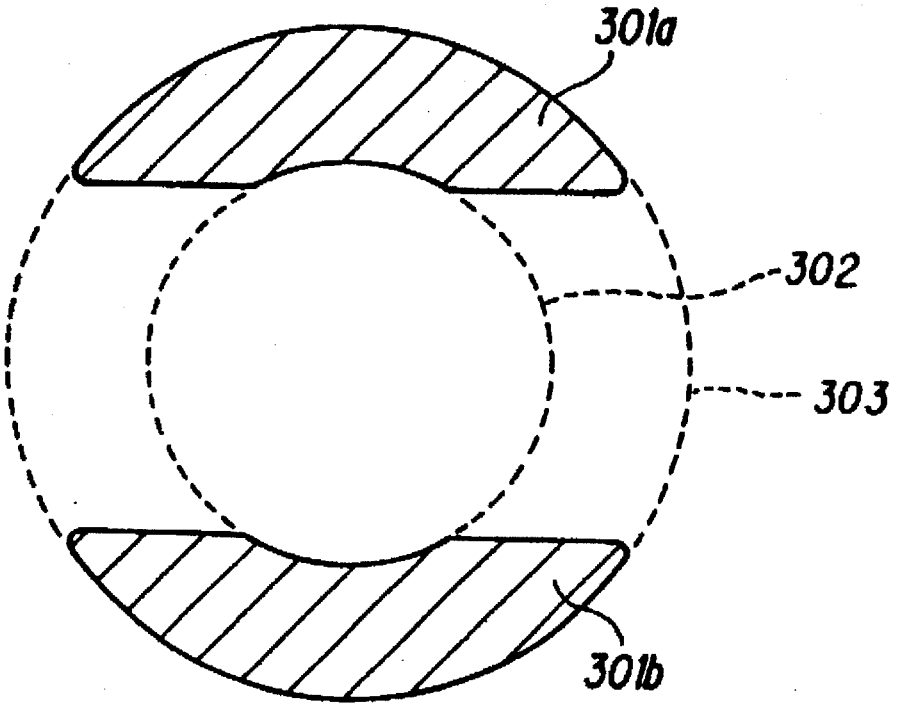
FIG. 3 is a pattern view of a key rubber contact point printed on the rear surface of a key rubber in the key switch according to an embodiment of the present invention.

FIGS. 1A to 1C are pattern views of each layer (a carbon layer 208, a silk layer or a resist layer 206, and a copper foil layer 205) to be printed on a printed wiring substrate of the key switch in the embodiment. FIG. 2 is a schematic sectional view showing the key switch according to the embodiment. FIG. 3 is a pattern view of a key rubber contact point 209 to be printed on the rear surface of a key rubber 201 of the key switch according to the embodiment.

At first, a description is made for the surface where a carbon electrode pattern is formed with reference to FIGS. 1A to 1C and FIG. 2. In FIG. 2, two copper foil layers (203 and 205). sandwiching a FR-4 layer 204 therebetween on the printed wiring substrate 202, a resist layer 206 is formed on the copper foil layer 205 and a silk layer 207 on top thereof, and further, a carbon layer 208 is formed on the silk layer 207. It should be noted that the reason why the silk layer 207 is formed is for further enhancing luminous efficiency of light emitting elements placed for a back light.

The carbon electrode pattern, as shown in FIG. 1A, is formed with stripe electrode patterns 101 to 108 and 110 and 118 in which a minus electrode and a plus electrode are alternately positioned. Herein, odd reference numerals in ranges of 101 to 108 and 111 to 118 are assigned to the minus electrode, while even reference numerals in the same ranges are assigned to the plus electrode respectively. Also in the figure, reference numerals 121*a* and 121*b* each indicate sites for placing light-emitting diodes (LED).

The silk pattern and the resist pattern, as shown in FIG. 1B, are patterns where a plurality of holes for connecting the carbon electrode pattern in the carbon layer 208 to the copper foil pattern in the copper foil layer 205 are made. The holes 131 to 138 and 141 to 148 each correspond to electrode patterns 101 to 108 and 111 to 118 respectively, and carbon is imbedded in those holes 131 to 138 and 141 to 148 when a carbon electrode pattern is to be printed.

In the copper foil pattern, as shown in FIG. 1C, a copper foil wiring pattern 150 connecting between minus electrode patterns (odd reference numerals in ranges of 101 to 108 and 111 to 118) and a copper foil wiring pattern 160 connecting between plus electrode patterns (even reference numerals in the same ranges) are formed.

Next, a description is made for the surface on which the contact point pattern is formed with reference to FIG. 2 and FIG. 3. As shown in FIG. 2, the key rubber contact point 209 is formed on the rear surface of the key rubber 201. Namely, as shown in FIG. 3, the contact points are formed on the region sandwiched by concentric circles 302 and 303 as contact point patterns 301*a* and 301*b* by using portions of both edges in the upper and lower section.

The carbon electrode pattern as described above, when the key rubber 201 is pressed down, is positioned so that the carbon electrode pattern is superimposed on the contact pattern. Namely, the stripe electrode patterns 101 to 108 and 111 to 118 each correspond to the contact point patterns 301*a* to 301*b* respectively. Accordingly, by contacting with the contact point 301*a*, a minus electrode and a plus electrode in the electrode pattern 101 to 108 are conducted to each other, while by contacting the contact point 301*b*, a minus electrode and a plus electrode in the electrode pattern 111 to 118 are conducted to each other.

As described above, in the key switch according to the embodiment, because light-emitting diodes for back light are provided at the position of 121*a* and 121*b* inside the key region, a region used as an electrode pattern is limited, but by providing stripe electrode patterns 101 to 108 and 111 to 118 thereon, it is possible to realize a switch assuring continued high-reliability without causing imperfect contact at the contact point due to increase of contact resistance.

Also even in the case where pressure for pressing down the key rubber 201 is local thereon, conduction of the electrodes adjacent each other at any parts of the stripe electrode patterns 101 to 108 and 111 to 118 allows the key switch to be in a state of connection, so that accurate switching becomes possible, which makes it possible to enhance reliability of the switch.

Forming an electrode pattern with carbon allows the manufacturing process to be simplified and cost reduction of the products to be achieved, and in addition thereto, as shown in FIG. 1A, electrode patterns having stripes inclining in a certain direction are employed for carbon electrode patterns 101 to 108 and 111 to 118, so that defects such as a missing part in print are hardly generated and product yields can be enhanced.

Figure 1D:
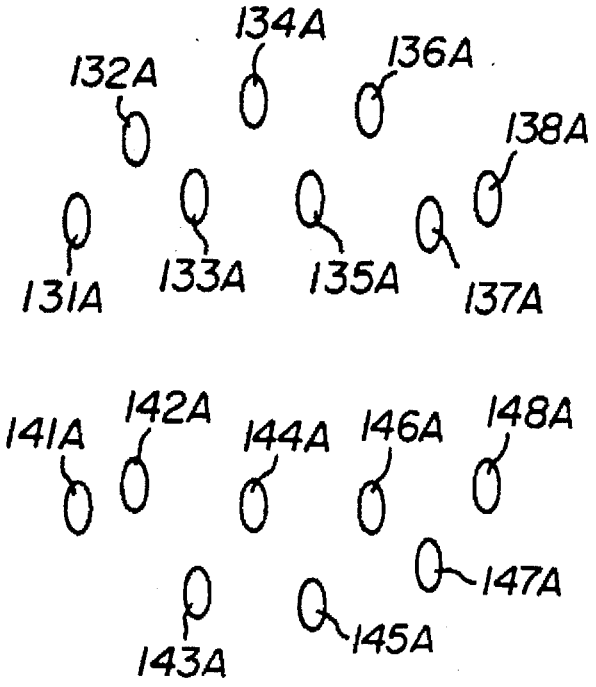

It should be noted that, in the embodiment, a circle as shown in FIG. 1B is employed as a form for the holes 131 to 138 and 141 to 148 in the silk patten or resist pattern, but an ellipse in the longitudinal direction in which stripes of a carbon electrode pattern are inclined may be formed as the form described above. This aspect is illustrated in FIG. 1D with elliptical holes 131A to 138A and 141A to 148A in the silk pattern or resist pattern. With this configuration, contact resistance can further be reduced, which makes it possible to enhance the reliability of the switch.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A switch comprising:

first and second planar elements opposing and substantially in parallel to each other for switching connection or disconnection between a first electrode and a second electrode when the first planar element is pressed down;

a conductive contact point pattern having a specified form on a portion of the first planar element; and a striped electrode pattern, comprising first and second alternating electrodes, on the second planar element in a region where the conductive contact point wiring pattern is superimposed thereon upon depressing the first planar element.

2. A switch according to claim 1, where the electrode pattern on said second planar element is formed with carbon.

3. A switch according to claim 1, wherein other parts different from said switch are provided on said second planar element in the region where the planar elements are superimposed upon depressing said second-planar element.

4. A switch according to claim 3, where the electrode pattern on said second planar element is formed with carbon.

5. A switching device for making connections between a first electrode and a second electrode in an electric circuit, comprising:

a first layer covered with an electrode pattern including a plurality of first contacts coupled to said first electrode, and a plurality of second contacts coupled to said second electrode; and a second layer having, on a portion thereof, a conductive contact pattern of a specified form arranged to contact said electrode pattern when said second layer is pressed towards said first layer.

6. The device of claim 5, wherein said electrode pattern comprises the first contacts arranged between the second contacts.

7. The device of claim 5 further comprising a light-emitting element provided at the first layer.

8. The device of claim 5, wherein said first and second contacts are arranged around said light-emitting element.

9. The device of claim 5, wherein said first and second contacts are made of carbon.

10. The device of claim 5, further comprising a conductive layer having a first conductive pattern coupled to said first electrode, and a second conductive pattern coupled to said second electrode.

11. The device of claim 10, wherein said first and second conductive patterns are made of copper foil.

12. A switching device for making connections between a first electrode and a second electrode in an electric circuit, comprising:

a first layer covered with an electrode pattern including a plurality of first contacts-coupled to said first electrode, and a plurality of second contacts coupled to said second electrode;

a second layer having a contact pattern arranged so as to come into contact with said electrode pattern when said second layer is pressed towards said first layer;

a conductive layer having a first conductive pattern coupled to said first electrode;

a second conductive pattern coupled to said second electrode; and a resistor layer formed between said first layer and said conductive layer and having a pattern of holes arranged so as to provide mechanical contacts between said first contacts and said first conductive pattern, and between said second contacts and said second conductive pattern.

13. The device of claim 12, further comprising a silk layer formed between said first layer and said resistor layer and having a pattern of holes arranged so as to provide mechanical contacts between said first contacts and said first conductive pattern, and between said second contacts and said second conducive pattern.

14. The device of claim 12, wherein said first and second contacts are formed of stripes parallel to each other and to a first direction.

15. The device of claim 14, wherein said holes are formed in the shape of ellipses having longer axes extending in the first direction.

16. The switch according to claim 1, wherein said striped electrode pattern comprises:

a first striped alternating electrode pattern formed in a region of the second planar element; and a second striped alternating electrode pattern, substantially similar to the first striped interdigited electrode pattern, formed in another region of the second planar element spaced apart from the first striped alternating electrode pattern.

* * * * *